US007293427B1

(12) United States Patent
Cushnie

(10) Patent No.: US 7,293,427 B1
(45) Date of Patent: Nov. 13, 2007

(54) BEVERAGE COOLING APPARATUS AND METHOD

(76) Inventor: Pamela F. Cushnie, P.O. Box 1632, Kamuela, HI (US) 96743

( * ) Notice: Subject to any disclaimer, the term of this patent is extended or adjusted under 35 U.S.C. 154(b) by 173 days.

(21) Appl. No.: 10/920,594

(22) Filed: Aug. 17, 2004

(51) Int. Cl.
*F25D 3/08* (2006.01)

(52) U.S. Cl. ..... 62/457.3; 62/371

(58) Field of Classification Search .... 62/457.1–457.4, 62/371, 530
See application file for complete search history.

(56) References Cited

U.S. PATENT DOCUMENTS

| | | | | |
|---|---|---|---|---|
| 1,511,451 | A | | 10/1924 | Folger |
| 1,944,726 | A | | 1/1934 | Aiken |
| 2,021,368 | A | | 11/1935 | Louis |
| 2,438,643 | A | | 3/1948 | Moore |
| 2,591,375 | A | | 4/1952 | Radford |
| 2,602,302 | A | | 7/1952 | Poux |
| 2,876,634 | A | | 3/1959 | Zimmerman et al. |
| 4,134,494 | A | | 1/1979 | Wong |
| 4,324,111 | A | | 4/1982 | Edwards |
| 4,908,248 | A | | 3/1990 | Nakashima et al. |
| 4,931,333 | A | | 6/1990 | Henry |
| 4,981,022 | A | | 1/1991 | Snyder |
| 5,009,083 | A | | 4/1991 | Spinos et al. |
| 5,129,238 | A | | 7/1992 | Schwartz et al. |
| 5,235,823 | A | | 8/1993 | Coker |
| 5,357,761 | A | | 10/1994 | Schauer |
| 5,456,090 | A | | 10/1995 | McCoy |
| 6,086,240 | A | * | 7/2000 | Murphy ..... 366/147 |
| 6,103,280 | A | * | 8/2000 | Molzahn et al. ..... 426/109 |
| 6,494,056 | B1 | | 12/2002 | Roth et al. |
| 2004/0123620 | A1 | * | 7/2004 | Porter ..... 62/457.3 |

* cited by examiner

*Primary Examiner*—Melvin Jones
(74) *Attorney, Agent, or Firm*—Robert M Hunter

(57) ABSTRACT

An apparatus and method for cooling a food or beverage to a temperature at which the food or beverage is safe to consume. A preferred embodiment of the beverage cooling device comprises a single cooling unit that contains a coolant material. Another preferred embodiment comprises a collection device; and a plurality of cooling units attached to the collection device, each of the cooling units comprising a tubular container containing a coolant material.

17 Claims, 3 Drawing Sheets

BEVERAGE COOLING APPARATUS AND METHOD

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to an apparatus and method for cooling a hot food or beverage. In particular, the invention relates to an apparatus and method for cooling a hot beverage or a hot liquid, semi-liquid or solid food product.

In retail establishments, such as coffee shops, beverages may be dispensed at temperatures (e.g., 180 Fahrenheit, F.) that are unsafe to consume. At home, consumers often mistakenly overheat their food products, and they and their children are faced with the problem of how to safely and quickly cool an excessively hot beverage, soup, stew, etc.

Microwave ovens are frequently used by children without adult supervision, and applicant's invention is a way to mitigate a problem associated with this practice. Children are often unaware of the dangers of food being too hot, and are less able to find ways to cool food.

Some retail establishments provide ice cubes to cool the hot beverages they sell, causing a dilution of the beverage, and providing the user with no ability to control the amount of cooling. Once the ice cube is in a beverage, it cannot easily be retrieved. If the beverage is allowed to cool at ambient room temperature, time is wasted and the other elements of the meal may become too cool.

The background art is characterized U.S. Pat. Nos. 1,511,451; 1,944,726; 2,021,368; 2,438,643; 2,591,375; 2,602,302; 2,876,634; 4,134,494; 4,324,111; 4,908,248; 4,931,333; 5,357,761; 5,235,823; 5,456,090; the disclosures of which patents are incorporated by reference as if fully set forth herein.

Folger in U.S. Pat. No. 1,511,451 discloses a refrigerating apparatus mounted on a vehicle. The refrigerating apparatus is a chamber into which materials to be frozen are placed. Large cooling units are pre-cooled and then also placed in the chamber. The cooling units are made of standard steel tubing and plugged with threaded caps. This material and application preclude use inside a single beverage container, and the cooling units are not meant to come into contact with a food or beverage. This invention is limited in that it does not allow the user to cool a small quantity of a beverage in a normal home or commercial environment. The disclosed large steel units are not very portable, are not useable by children and are not food safe.

Aiken in U.S. Pat. No. 1,944,726 discloses a cooling unit. This invention is limited in that the sealed member is made of corrugated metal which is probably not food safe in acidic foods or beverages. Moreover, the disclosed fluted or corrugated surface is not easily cleaned of food adhering to it. Thus, a child may not be able to thoroughly clean the surface before re-freezing the unit, causing even more food or beverage to adhere to the unit the next time it is used. An assembly comprising a plurality of cooling units is not disclosed. Because the cooling unit is metallic, the user is not able to put the unit (with the coolant material removed) into a microwave oven for sterilization or cleaning.

Louis in U.S. Pat. No. 2,021,368 discloses a beverage delivery apparatus. This invention is limited in that the disclosed (narrow) siphon spout does not allow any partially solid food stuffs to be cooled and dispensed. The disclosed invention is useful only for use with large beverage containers, such as beer kegs, and not for a user's cup, mug, glass, or bowl of food. Metal chains are used to connect the hollow balls end to end, making it incapable of use in a small beverage container. Moreover, the metal components cannot be guaranteed to be food safe.

Moore in U.S. Pat. No. 2,438,643 discloses a pack for use in refrigeration anesthesia. This invention is limited in that it cannot be used to cool individual portions of beverages. Moreover, the units are covered in rubber and fabric, with seams in the fabric to produce a hinge-like connection, and laces to hold the coolant unit in place on the surface of a human body. The materials are not food safe, and the structure does not lend itself to submersion in a single-portion beverage container.

Radford in U.S. Pat. No. 2,591,375 discloses a cooling device for drinks, soups or the like. This invention is limited in that it does not solve the problem of providing a plurality of cooling units, providing the user with the option of employing more than one cooling unit to cool a beverage. Nor is there structure provided that permits efficient collection of cooling units, hence, the need for a thermometer in the disclosed device. Moreover, the disclosed cooling device is openable and closable in order to allow the user to frequently replenish the dry ice coolant material. It is not safe for the user to be handling dry ice. Nor is it food safe for a glass cooling device to be dropped in the beverage or food container. The choice of materials to be used with this device is very limited, with metals not being food safe, and glass not being safe for use by adults or children. There is a significant amount of assembly and disassembly required by the user to use the device even once. Multiple uses of the single cooling unit would be ineffective, as too much time would pass between applications, and there is no disclosure of multiple cooling units. The actual size of the disclosed container would be dictated by the size of the frozen solid that needs to be inserted into the container. A large cooling device would displace a significant amount of beverage. There is no disclosure of use of standardized amounts of coolant material, and no a way for a typical user to store the dry ice coolant material.

Poux in U.S. Pat. No. 2,602,302 discloses a combination ice and hot pack. This invention is limited in that the device is supposed to be applied to the exterior of a human body part, and is not configured for submersion into food stuffs or beverages. Moreover, the disclosed plurality of the independent compartments is provided so that the compartments can collectively be applied to the outside of a body part or surface. The material is designed to allow flexibility of the joined units and is not meant to be submerged into a consumable beverage. The structure of the device does not allow its use for cooling of a beverage.

Zimmerman et al. in U.S. Pat. No. 2,876,634 discloses a thermodynamic container. This invention is limited in that, once the beverage is placed in the disclosed container, there is no user control over the cooling process. The beverage must then be poured from the cooling container into another container in order to stop the cooling process. The problems of lack of user convenience, multiple containers being dirtied by the transfer from container to container, and lack of control over the cooling process have not been solved.

The cooling material of choice is disclosed as bees wax, contained by another material providing an outer surface. Modern refrigeration may not be able to adequately freeze the beeswax without cracking the surface material, creating a contact that is not food safe. Moreover, there is no provision made for deploying a plurality of cooling units.

Wong in U.S. Pat. No. 4,134,494 discloses a combination straw and stirrer. This invention is limited in that the enlarged central section, when used as a straw, is difficult to clean, as food and liquids remain in the enlarged central section after being drawn into the cylinder. The two very small plugs could become misplaced, and even lost in the beverage, causing a safety hazard to the user. There is no provision for the expansion of the frozen material in the stirrer, and the plugs could be forced out, again creating a safety hazard, and making the stirrer unusable, since the liquid would melt into the beverage. The length and diameter of the stirrer are limited by virtue of its use as a straw. A larger diameter would allow more coolant to be used, but would also make the straw concept impractical and difficult to use, since the user would not be able to easily draw the beverage through a large diameter straw. The disclosed invention does not solve the problem of providing a plurality of devices, in case the user would want to employ another application for cooling the beverage or food material, nor is there a provision made in the design to permit efficient collection of said devices. The plugs necessary for the safe use of this device could be lost and allow leaking of the coolant material into the user's food or beverage.

Edwards in U.S. Pat. No. 4,324,111 discloses a freezing gel containment structure and method. This invention is limited in that the disclosed freezing gel tubes are attached and oriented parallel to each other. There is no provision made for use of a single tube, and use of one or more additional tubes, if needed. The user is not able to pre-select or modify the number of cooling units to employ. The tubes and coolant material are designed for use around the outside of the food material, not for immersing (total submergence) in the food or beverage. Moreover, the device is designed to provide long-term cooling, not just a reduction of temperature to meet the user's need. Thus, the Edwards invention is not designed to lower the temperature of the food or beverage from hot to warm, but rather only to attempt to create a cold food material.

Nakashima et al. in U.S. Pat. No. 4,908,248 disclose a cooling device that can be attached to any body part or to an object such as a beer bottle. This invention is limited in that it is neither intended nor designed to be placed inside a single-portion container for cooling a beverage. It has a further limitation in that it must be attached to the outside of the object to be cooled.

Henry in U.S. Pat. No. 4,913,333 discloses a thermal packaging assembly. This invention is limited in that the cooling unit is designed to be packed around items, not inserted into a container containing a food or beverage. This invention was not meant to cool a food quickly and then be removed. It is meant to cool over a long period of time, thereby making this invention inefficient for quick, short-term cooling of a beverage. This invention provides a large amount of air space around each capsule when packed. It was not meant to be submerged in an open beverage container and then removed by the user. The excessive cushioning around each cooling capsule would not be practical for insertion into a beverage, as it would displace the beverage in the container.

Snyder in U.S. Pat. No. 4,981,022 discloses a refrigerated bicycle beverage carrier. This invention is limited in that it requires that the user purchase the entire bottle/cooler system. The entire bottle/cooler system must be placed in a freezer in order to make the coolant portion useful, not solving the problem of space efficiency. This device limits the user's ability to cool a beverage or food material to that quantity of food or beverage that can be contained by the disclosed container. The user cannot cool food and beverage quantities greater than permitted by the disclosed container size. The user has no control over the amount and duration of cooling, because the food material must be either left in the disclosed container, or removed to another container to stop the cooling process. This device does not solve the problem of the user who wants to employ more than one cooling unit for cooling the beverage or food material, nor is there a provision made in the design to permit efficient collection of said cooling units. Any breakage of the plastic tube and welded areas would necessitate no longer being able to use the entire cooler system.

Spinos et al. in U.S. Pat. No. 5,009,083 discloses a beverage cooler. This invention is limited in that it relies on an inner container and a straw apparatus for drinking the beverage. The user has no control over the amount and duration of cooling, since the food material must be either left in the disclosed container, or removed to another container to stop the cooling process. This device does not solve the problem of the user who wants to employ more than one cooling unit for cooling the beverage or food material, nor is there a provision made in the design to permit efficient collection of said cooling units.

Schwartz et al. in U.S. Pat. No. 5,129,238 disclose a soft drink container cooler. This invention is limited in that it is not useable in a variety of single-portion drink containers because it must be screwed into a special receiving unit having a matching threaded opening. This precludes cooling any food other than a liquid, because the user must then be able to drink the liquid through a special opening in the threaded container top. Any food comprising chunks of food solids would not fit through the opening. There is no provision made for multiple units to further cool the beverage, and each additional separate unit, must be unscrewed, and a new unit re-inserted and screwed into the container top. This device does not solve the problem of the user who wants to employ more than one cooling unit for cooling the beverage or food material, nor is there a provision made in the design to permit efficient collection of said cooling units. This design does not solve the problem of providing a one piece unit, without separate parts that could be lost or allow the coolant material to leak into the user's food or beverage.

Coker in U.S. Pat. No. 5,235,823 discloses a cooling device. This invention is limited in that it is designed to be used to maintain a cold temperature over a long period of time. It does not solve the problem of a quick, short-term reduction in temperature by the user in order to make a beverage or food material safer to ingest. This device does not solve the problem of the user who wants to employ more than one cooling unit for cooling the beverage or food material, nor is there a provision made in the design to permit efficient collection of said cooling units. The threaded cap and plug do not solve the problem of providing a one-piece cooling unit, without separate parts that could be lost or allow leaking of the coolant material into the user's food or beverage. The prior art device illustrated in FIG. 6 of this reference requires that the cavity for the coolant material encompass the entire cooling unit and does not teach the features of the invention disclosed herein.

Schauer in U.S. Pat. No. 5,357,761 discloses a universal thermal insert for beverage containers. This device is meant to be used for continued cooling for extended periods of time and does not solve the problem of the short-term user who needs an immediate solution for an individual cooling event. The stabilizing fins do not allow for ease of insertion into many containers, and would be of little use if the container cross section was wider than the fins were designed to fit, such as a bowl. The fins would not be easily cleaned if food material were to be caught on the fins, so this does not solve the cleaning problem, especially when used by children or elderly users. This invention does not give the user any choice in application to a variety of household eating containers. The size of the fins limits the food container choice, and could present problems if forced into an opening too small for the design. Thus, application of any force would cause the contained beverage to splash out of the container. This invention is not designed to be used with any food materials with greater thickness or consistency than liquid foods. It does not solve the problem of how to cool stews or similar thick food materials. This device does not solve the problem of the user who wants to employ more than one cooling unit for cooling the beverage or food material, nor is there a provision made in the design to permit efficient collection of said cooling units.

McCoy in U.S. Pat. No. 5,456,090 discloses a baby bottle ice. This invention is limited in that it is meant to be left in the bottle through the elaborate use of O-rings, held in place by a base rim. This invention does not easily permit multiple cooling uses, as the entire device must be removed, O-rings removed, and the base rim removed before another use. This device must be left in place, within the special bottle, while the beverage is consumed, not giving the user any control over the amount of cooling and length of cooling time. This device is intended to maintain the cool temperature over a long period of time, not just for a short-term application. This device does not solve the problem of cooling the contents of a variety of containers and sizes, since the device is dependent on the base collar and insert fitting only a corresponding bottle opening and depth. If the other containers do not fit the necessary opening and rim cap size, the liquid will spill out as the user drinks, since the insert must remain inside the container. Moreover, this device does not solve the problem of the user who wants to employ more than one cooling unit for cooling the beverage or food material, nor is there a provision made in the design to permit efficient collection of said cooling units.

Roth et al. in U.S. Pat. No. 6,494,056 disclose a method and system for cooling beverages already contained in a bottle, with a self-matching mouth/lid/collar. This invention is limited in that the material contained in the thermal energy-storage member is not water, and it is unclear whether the contents are food safe if leakage should occur. The disclosed apparatus cannot be used with other user-provided containers. This device does not solve the problem of the user who wants to employ more than one cooling unit for cooling the beverage or food material, nor is there a provision made in the design to permit efficient collection of said cooling units. The threaded cap does not solve the problem of providing a one piece unit, without separate parts that could be lost or allow leaking of the coolant material into the user's food or beverage.

The foregoing review reveals that the problems remain unsolved by background art devices and methods. The structure of the invention disclosed herein solves those problems in ways that are not suggested by others. What is still needed is a way to cool individual portions of hot food and beverages in a safe and convenient manner.

BRIEF SUMMARY OF THE INVENTION

The purpose of the invention is to mitigate the problem of an overly hot food or beverage product (e.g., coffee, soup, stew, water) burning the mouth of a consumer. For the purposes of this disclosure, the term food or beverage means any liquid, semi-liquid or solid item that consumable by a human. An advantage of the invention is that allows the user to easily, quickly, and repeatedly cool a food or beverage to a temperature at which the food or beverage is safe to consume.

One object of preferred embodiments of the invention is to accommodate a variable amount of cooling of a food or beverage. Another object of preferred embodiments of the invention is to facilitate quickly lowering the temperature of a food beverage to a temperature at which is it is safer to ingest. Yet another object of preferred embodiments of the invention is to allow the submerging or immersion of a cooling unit in a beverage, rather than having to wrap a device around a food or beverage container, or having to place the food or beverage container into any large box or refrigeration unit. A further object of preferred embodiments of the invention is to allow a user to withdraw the cooling unit at any appropriate time, thus solving the problem created by other devices wherein the food or beverage must remain exposed to the cooling device for a long period of time. This aspect of the invention permits the user greater control over the cooling process. Other inventions require the user to leave the apparatus in contact with the food or beverage, and the user is unable to stop the cooling process when desired.

Another object of preferred embodiments of the invention is to allow the user the option of either applying a single cooling unit to the food or beverage, or concurrently, or sequentially, applying other cooling units for further cooling if needed. Yet another object of preferred embodiments of the invention is to avoid cooling unit elements that could create a choking hazard if lost or separated from the body of the cooling unit. Another object of preferred embodiments of the invention is that no metal parts are included that might create a chemical reaction or by-product when used with acidic foods or beverages. Yet another object of preferred embodiments of the invention is to provide a device that contains no coolant, gel, sawdust, fabric or beeswax that might not be food safe. Another object of preferred embodiments of the invention is to impose no limitation on the sizes of the containers in which the cooling units can be used. Preferred embodiments of the invention are functional in a great variety of food and beverage containers.

Yet another object of preferred embodiments of the invention is to be extremely space efficient, with no unneeded air space, cushioning, sawdust, padding, or absorbent materials necessary for optimal functioning. Another object of preferred embodiments of the invention is to be capable of withstanding a wide range or temperatures and to be microwave safe. Yet another object of preferred embodiments of the invention is to eliminate the need for the user to transfer the food or beverage from a cooling container to yet another container for consumption. By immersing or inserting or submerging the cooling unit of preferred embodiments of the invention into a food or beverage container, the cooling unit is in direct contact with the food or beverage material to be cooled. Thus, preferred embodiments of the invention solve the problem of first having to cool the food container before the contents of the food container can be cooled. In this way, preferred embodiments of the invention are more energy efficient and time efficient. Another object of preferred embodiments of the invention is to eliminate the requirement for additional parts that must be located, maintained, purchased and employed, such as O-rings, base collars, plugs, fins, cooling boxes, chains, tubes, and thermometers in order to make it useful.

Yet another object of preferred embodiments of the invention is to be useable with a wide variety of foods and beverages, from liquids to semi-solids and even solids. It solves the problem presented by other inventions that necessitate their use only with liquids. Another object of preferred embodiments of the invention is that there is no requirement that it be left in the beverage or food container after cooling has occurred. Preferred embodiments of the invention are easily removed from the container before the food or beverage is ingested, providing the user with less weight to move each time the user needs to move the food container. This solves the problem of the user having to lift the cooling device every time the user wants to use the food container.

Another object of preferred embodiments of the invention is that maintenance of a certain (pre-selected) temperature is not required, so it is not limiting to a user who wishes to continue application of a cooling unit to the food container. Once the optimum temperature is reached, the cooling unit may be removed. A further object of preferred embodiments of the invention is that the cooling unit does not have be fluted, corrugated, threaded, plugged or have a porous surfaces. Food particles tend to stick to surfaces that are not smooth, creating problems in cleaning and maintaining background art devices so they do not become a health hazard.

Another object of the invention is that a large quantity of food or beverage does not have to be cooled in order to make the device cost-effective. Barrels of beverages are not required for preferred embodiments of the invention to be used effectively. A further object of the invention is to avoid the requirement for a large cooling apparatus in order to be effective. Large metal tubes or bags of coolant are not necessary in order for preferred embodiments of the invention to be useful. Preferred embodiments of the invention are designed to be used on a single-portion food or beverage unit.

Another object of preferred embodiments of the invention is to provide means for a plurality of cooling units to be collected and easily maintained. This allows other cooling units to be conveniently and immediately available for a second application. Yet another object of the invention is to facilitate assembly and disassembly of the device by the user. Another object of preferred embodiments of the invention is to provide portability. Even young children and elderly persons are able to use the device, both at home and away from home. It is neither heavy, as some other inventions are, nor bulky with additional air-space, padding, refrigeration boxes and cushioning. Preferably, there is no glass, mercury, metal, or thermometer, as with other inventions, to pose a safety hazard.

Another object of preferred embodiments of the invention is to give the user control over the cooling process by allowing the user to visually determine how far the user wants to insert the cooling device into the food or beverage container. The device may be configured to give the user a visual means for determining whether the coolant material in the cooling unit is in a frozen or liquid state. The user has the ability to choose which cooling unit of a plurality of cooling units the user wants to use or freeze, depending on need. In preferred embodiments, at least a portion of the device (e.g., the collecting device) is designed to be able to rest on the rim of the container so the user does not have to hold it.

The invention is an apparatus and method for cooling foods and beverages. In a preferred embodiment, the invention is an apparatus that comprises one or more cooling units, with each cooling unit comprising a coolant material in a cooling material container. In a preferred embodiment, the coolant material is permanently held in each cooling material container, which is preferably sealed at both ends. The shape of the cooling material container may be tubular (e.g., a tube) or another shape. The cooling units are preferably capable of being frozen and then individually or collectively put into a hot food or beverage in hot food or beverage container. After a cooling unit has absorbed heat from the food or beverage, it serves as a thermal energy storage device. Because the coolant material contents of the cooling unit are preferably frozen, the cooling unit can absorb heat from external environments, so each device is capable of reducing the temperature of a food or beverage, and use of several cooling units simultaneously can produce quicker cooling. The material of the cooling unit container is food safe, able to be repeatedly frozen and heated without leaking, of adequate size and shape to fit into background art food and beverage containers, and is easily cleanable.

In another preferred embodiment, the invention is comprised of one or more cooling units and a cooling unit collector. Preferably, the cooling unit collector holds a plurality of cooling units in either a fixed or movable relationship with one another.

In preferred embodiments, the invention mitigates the possibility of accidental scalding of body parts because it offers a means for cooling a food or beverage to a more reasonable temperature. Preferably, the present invention is directed to devices and methods for enhancing the quality of consumable beverages and semi-liquid foods and, more specifically, to a system for use with a consumable food product and a method of providing a cooler temperature of the food before consumption. The applicants' discovery is useful because it is able to meet individual consumer needs for food and beverage temperature reduction, is reusable, and can be safely used by children. In a preferred embodiment, there is nothing breakable, and no unsafe ingredients are used in the coolant material. The shape of the cooling unit fits a multitude of containers and is easily cleaned, ready for freezing and re-use.

In preferred embodiments, the invention enables children to easily and independently cool their food so as to prevent scalding of their mouths and tongues. The invention is better than ice cubes because it does not dilute the food product. Also, it allows the consumer to choose the number of cooling units to use in order to achieve the desired reduction in temperature. The invention has no unsafe coolant ingredients, so the coolant material may be water or any other safe coolant material, either liquid, semi-liquid, or a solid. The coolant material is preferably frozen before use, using readily-available freezing equipment found in most homes and restaurants. Cleaning the device after contact with food is performed easily and quickly. In preferred embodiments, the invention has no moving parts, other than those required to allow the user to choose the number of cooling units (thermal energy storage units) to use with each application.

In a preferred embodiment, the invention is an apparatus for cooling a food or beverage in a single-portion food or beverage container comprising: a collection device comprising a substantially circular ring (or band) having a permanently closed joint; and a plurality of cooling units, each of said cooling units comprising a top (which may or may not be constructed of a clear plastic) having a hole by which it is attached (e.g., the ring passes through the hole) to said ring and a threaded male portion, each of said cooling units further comprising a transparent tubular container (e.g., being constructed of a clear plastic) having an exterior, a part of said tubular container containing a cavity, said cavity having a substantially constant cross section and a threaded female portion that is attachable to said male portion and said cavity being at least partially fillable with a freezable coolant material (e.g., water) that is visible from the exterior of said tubular container, said tubular container and said coolant material being food safe (e.g., being approved by the U.S. Food and Drug Administration for use with human food) and said part (e.g., the part with the frozen water-filled cavity) being sufficiently small in size so as to be totally submergible in the food or beverage in the single-portion food or beverage container.

In another preferred embodiment, the invention is an apparatus for cooling a food or beverage in a single-portion food or beverage container comprising: a collection device; and a plurality of cooling units, each of said cooling units having a hole by which it is attached to said collection device, each of said cooling units comprising a tubular container, a part of said tubular container containing a cavity, said cavity having a substantially constant cross section and said cavity being at least partially filled with a freezable coolant material, said tubular container and said coolant material being food safe and said part being immersible in the food or beverage in the single-portion food or beverage container. Preferably, the collection device comprises a band or ring and each of the cooling units has an aperture through which the band or ring passes, whereby said cooling units are collectable on said collection device, either side-by-side or spaced apart. Preferably, said tubular container is fabricated of a plastic material, said plastic material being elastic and maintaining at least some of its elasticity at the temperature at which said coolant freezes. Preferably, each cooling unit is removable from said collection device. More preferably, the coolant material is water.

In another preferred embodiment, the invention is a process for cooling a beverage comprising: placing an apparatus disclosed herein in a freezer until the coolant material is frozen; removing the apparatus from the freezer; and completely submerging or immersing said part of at least one of the cooling units in a food or beverage, thereby causing the temperature of the food or beverage to decrease.

In another preferred embodiment, the invention is an apparatus for cooling a hot food or beverage, the apparatus comprising: a cooling unit comprising a first portion of waterproof paper or another disposable material; a second portion of waterproof paper or other disposable material that is bonded to said first piece of waterproof paper or another disposable material so as to create a single cavity and a tabular handle; and a volume of water at least partially filling said single cavity. Preferably, both portions are part of a single piece of waterproof paper or another disposable material. In another embodiment, each portion is a separate piece of waterproof paper or another disposable material.

In another preferred embodiment, the invention is an apparatus for cooling a hot food or beverage, said apparatus comprising: a plurality of the cooling units disclosed herein; and a collection device upon which cooling units are collected. Preferably, the collection device comprises a band or ring and each of the cooling units has an aperture through which the band or ring passes, whereby said cooling units are collectable on said collection device, close together or spaced apart.

In yet another preferred embodiment, the invention is an apparatus for cooling a food or beverage in a single-portion food or beverage container comprising: a collection device comprising a junction; and at least two cooling units immovably attached to said junction, each of said cooling units comprising a container, a part of said container containing a cavity that is at least partially filled with a freezable coolant material, said container and said coolant material being food safe and said end being immersible in the food or beverage in the single-unit (single-portion) food or beverage container. Preferably, the junction has four sides and one of four cooling units is immovably attached to each side of said junction.

In a further preferred embodiment, the invention is an apparatus for cooling liquid, semi-liquid or solid food for a user, the apparatus comprising: a collection device comprising an openable ring; and a plurality of cooling units, each of said cooling units comprising an easily-cleanable tubular container permanently containing a coolant material and each of said cooling units being attachable and detachable to said ring by the user, and said coolant material being visible to the user. Preferably, the collection device comprises a circular or non-circular band and each of the cooling units has an aperture through which the band is passable. Preferably, the coolant material is a freezable substance. More preferably, the coolant material is water.

Further aspects of the invention will become apparent from consideration of the drawings and the ensuing description of preferred embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

BRIEF DESCRIPTION OF THE SEVERAL VIEWS OF THE DRAWINGS

The features of the invention will be better understood by reference to the accompanying drawings which illustrate presently preferred embodiments of the invention. In the drawings.

Figure 1:
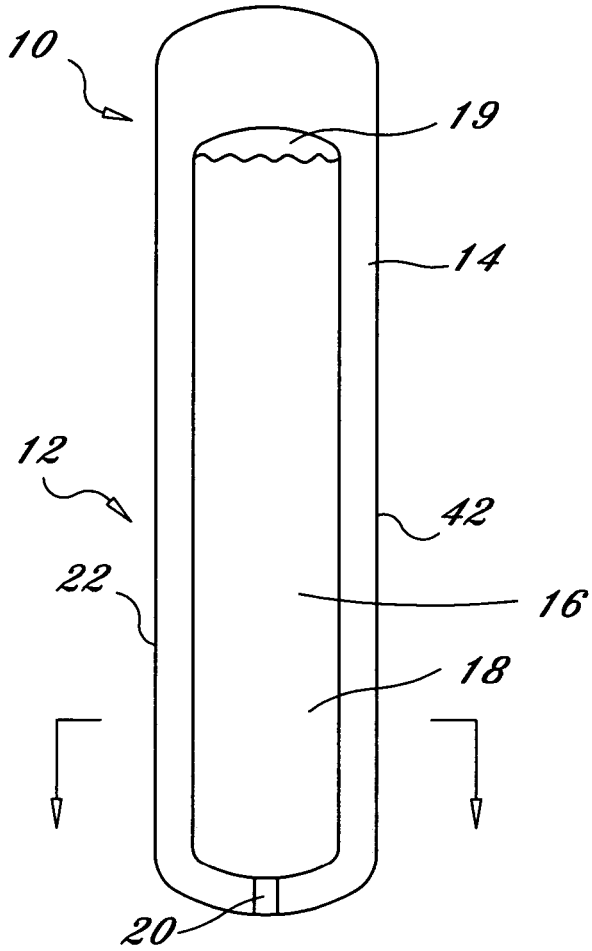
FIG. 1 is an elevation view of a preferred embodiment of the invention.

The following reference numerals are used to indicate the parts and environment of the invention on the drawings:

10 beverage cooling apparatus
12 cooling unit
14 body, tube
16 cavity
18 coolant material
19 air space
20 port
22 end
23 opening
24 removable cap
26 hole, aperture
30 collection device, junction
32 top
34 ring, band
36 joint
38 edges
40 handle, handhold
42 lower part, part

DETAILED DESCRIPTION OF THE INVENTION

Figure 2:
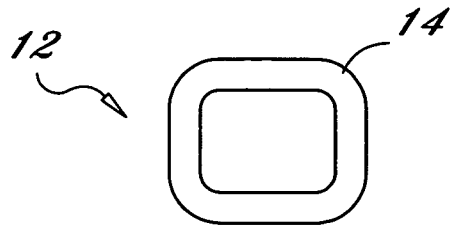
FIG. 2 is a cross section view of a preferred embodiment of the invention of FIG. 1.
Figure 3:
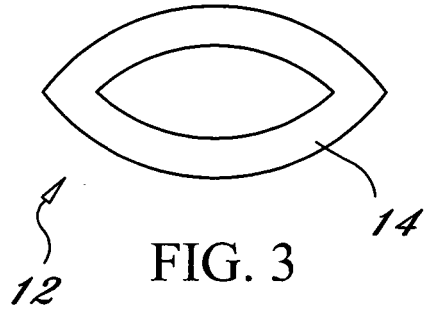
FIG. 3 is a cross section view of a preferred embodiment of the invention of FIG. 1.
Figure 4:
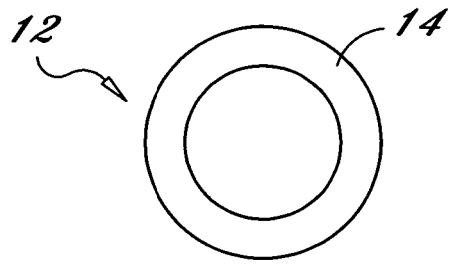
FIG. 4 is a cross section view of a preferred embodiment of the invention of FIG. 1.

Referring to FIG. 1, a preferred embodiment of beverage cooling apparatus 10 is illustrated. In this embodiment, beverage cooling apparatus 10 comprises a single cooling unit 12. Preferably, cooling unit 12 comprises a body or tube 14 having a cavity 16 in lower part 42 that is at least partially filled with coolant material 18. Body or tube 14 may have a variety of cross sections, including those illustrated in FIGS. 2-4. Cavity 16 may be completely filled with coolant material 18 or it may be partially filled with coolant material 18 leaving air space 19.

Figure 5:
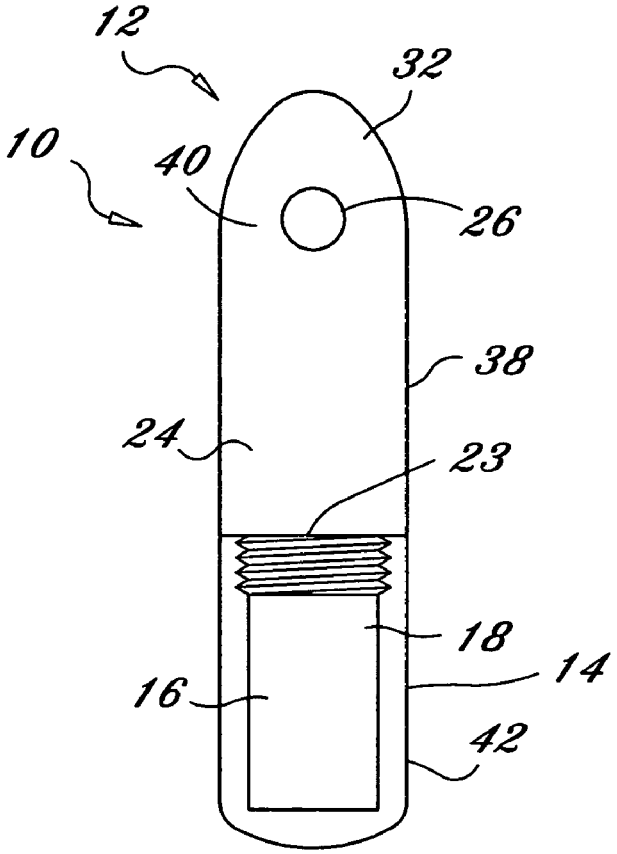
FIG. 5 is an elevation view of a preferred embodiment of a cooling unit of the invention that is constructed of a "see-through" plastic.

Referring to FIG. 5, a preferred embodiment of beverage cooling apparatus 10 is illustrated. In this embodiment, beverage cooling apparatus 10 comprises a single cooling unit 12. Preferably, cooling unit 12 comprises a transparent body or tube 14 having a single cavity 16 in lower part 42 that is at least partially filled with coolant material 18. In a preferred embodiment, part 42 is completely submersible (immersible) in a food or beverage in a single-unit food or beverage container. In a preferred embodiment, body 14 is made of a plastic material and coolant material 18 is water. Preferably, both body 14 and coolant material 18 are food safe, e.g., they are approved for exposure to and use with food by the U.S. Food and Drug Administration (FDA).

Preferably, tube 14 is about three inches long, but may be eight inches long or longer. Preferably, tube 14 is about one half inch in diameter, but may be one inch in diameter or more. Body 14 may be tubular in shape or a shape other than tubular (e.g., prismatic or tabular). In a preferred embodiment, body 14 is provided with a trade name or logo on its exterior surface or interior surface (the surface that forms cavity 16). Preferably, body 14 is provided with hole or aperture 26.

In a preferred embodiment, coolant material 18 is sealed in cavity 16 during manufacture of tube 14. For example, tube 14 could be manufactured by injection molding two halves that are fastened together by welding or adhering. Alternatively, blow molding technology could be used to manufacture tube 14 in one piece. Preferably port 20 is provided in end 22 through which coolant material 18 is introduced into cavity 16 before port 20 is permanently sealed. In another preferred embodiment, opening 23 is provided with removable cap 24 that can be removed by the user (e.g., by unscrewing or unsnapping) to allow the user to place coolant material 18 into cavity 16. Removable cap 24 is sufficiently large so as to not create a choking hazard should it become separated from tube 14.

In preferred embodiments in which coolant material 18 is water, cavity 16 is not completely filled with water to allow the water to expand during freezing. In other preferred embodiments in which coolant material 18 is water, body 14 is constructed of a plastic that is capable of expanding when the water freezes. One skilled in the art would be able to select a thermoplastic or thermoset plastic from which to construct body 14.

In the art, water is known to expand as its temperature is lowered from about 39 to 32 degrees F., lowering its density. Thus, frozen water (ice) floats in unfrozen water. Such an expansion with decreasing temperature is not observed in any other common liquid or for any common solid, except for rubber-like substances. For this reason, cooling unit constructed of rubber-like substances and having cavities that are filled with water are less likely to fracture when the water is frozen. In a preferred embodiment, therefore, the plastic material from which cooling unit 12 is constructed is elastic (rubber-like) and maintains at least some of its elasticity at the temperature at which coolant material freezes. For example, in preferred embodiments, a person skilled in the art would recognize that appropriate plastic materials include elastomers.

In an alternative embodiment, a disposable version of body 14 is made of a waterproof or water-resistant paper. Preferably, body 14 is fabricated by bonding edges 38 of one or two preferably rectangular pieces of waterproof paper together with an adhesive. Coolant material 18 is introduced into cavity 16 formed between the two pieces of paper. Preferably, tabular handle 40 is provided at top 32 of body 14. In this embodiment, cooling unit 12 is disposable. In other embodiments, other conventional or unforeseen disposable material (e.g., a plastic film or sheet) is substituted for paper.

Figure 6:
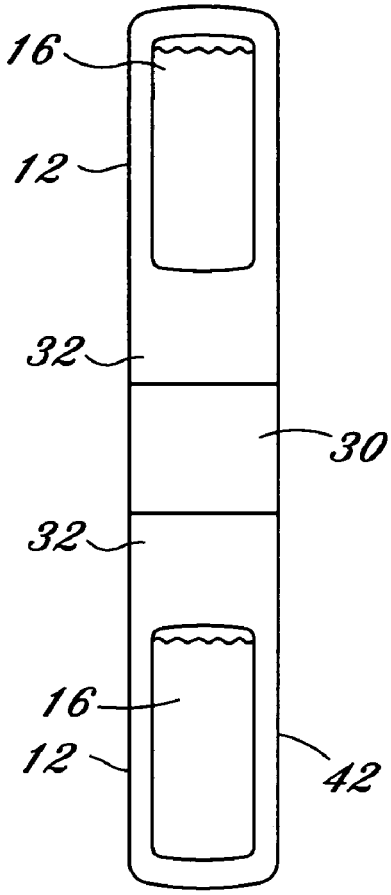
FIG. 6 is an elevation view of a preferred embodiment of a beverage cooling apparatus that is constructed of a "see-through" plastic.

Referring to FIG. 6, another preferred embodiment of beverage cooling apparatus 10 is illustrated. In this embodiment, beverage cooling apparatus 10 comprises two cooling units 12 that are attached to collection device 30. In this embodiment, collection device 30 is a tabular piece of plastic to which the cooling units are permanently and immovably attached at their tops 32. In an alternative embodiment, the cooling units are removably attached (e.g., screwed into) to collection device 30. Applicant envisions that a variety of finishes could be used at top 32, allowing collection device 30 to be joined to a plurality of tubes 12, creating a collection of cooling units 12 that are movable or unmovable with respect to collection device 30. Junction 30 may be of a variety of shapes to permit a plurality of cooling units 12 to be collected over a period of time, with the amount of cooling units and the duration of the collection to be determined by user. The design of collection device 30 may or may not permit the user to add or remove single cooling units 12.

Yet another preferred embodiment of the collection device would be to provide plastic junction 30 connecting optimally four cooling units 12 in the fixed form of a cross or plus sign, wherein the cooling units are not meant to be added, moved, or removed from the plastic junction to which they are fixed. Any of the collection devices 30 may be engraved or otherwise be marked with a trade name, logo, etc. that is visible on one or more of the surfaces of collection device 30.

Figure 7:
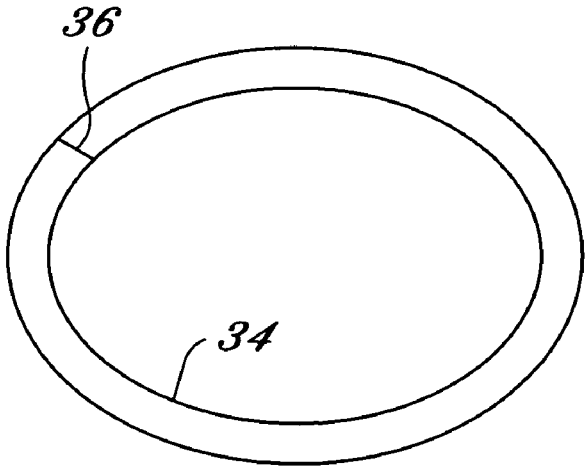
FIG. 7 is an elevation view of a preferred embodiment of the collection device of the invention.

Referring to FIG. 7, another preferred embodiment of collection device 30 is illustrated. In this embodiment, collection device 30 comprises ring or band 34. Preferably, the cross section of ring 34 is about one quarter inch in diameter, constructed of plastic and manufactured by injection molding. Ring 34, which may be circular or another shape, is preferably about three inches in overall average diameter. Preferably, ring 34 has joint 36 to allow a plurality of cooling units 12 to be collected on it by passing ring 34 through hole or aperture 26. Joint 36 may or may not be permanently closed after the cooling units are collected on ring 34.

Figure 8:
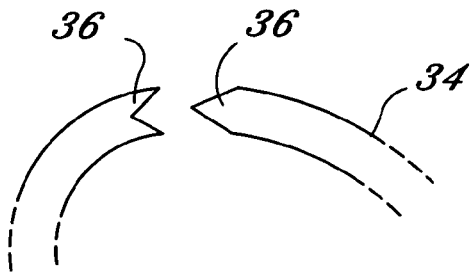
FIG. 8 is a partial elevation view of a preferred embodiment of the joint of the collection device of the invention.

Referring to FIG. 8, another preferred embodiment of joint 36 is illustrated. In this embodiment, joint 36 is openable to permit the user to open the two ends of ring to allow adding or removing of a cooling unit.

Figure 9:
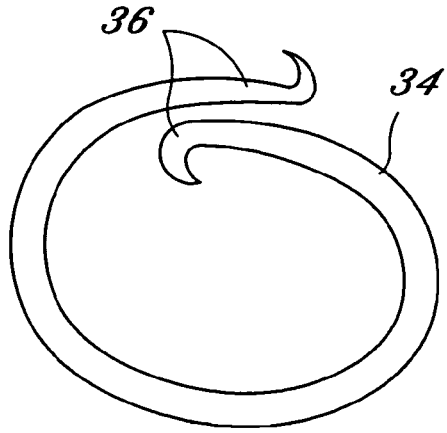
FIG. 9 is an elevation view of another preferred embodiment of the joint of the collection device of the invention.

Referring to FIG. 9, yet another preferred embodiment of joint 36 is illustrated. In this embodiment, joint 36 is openable to permit the user to open the two ends of ring to allow adding or removing of a cooling unit. Preferably, collection device 30 is configured to allow it to be inserted into aperture 26 at top 32 of one or more cooling units 12 and permit smooth movement of the one or more cooling units 12 along collection device 30.

Figure 10:
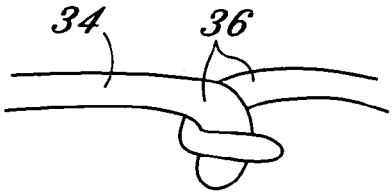
FIG. 10 is a partial elevation view of another preferred embodiment of the joint of the collection device of the invention.

Referring to FIG. 10, another preferred embodiment of joint 36 is illustrated. In this embodiment, joint 36 is openable to permit the user to open the two ends of ring to allow adding or removing of a cooling unit. In other embodiments, other conventional or unanticipated joining means are incorporated into collection device 30.

Figure 11:
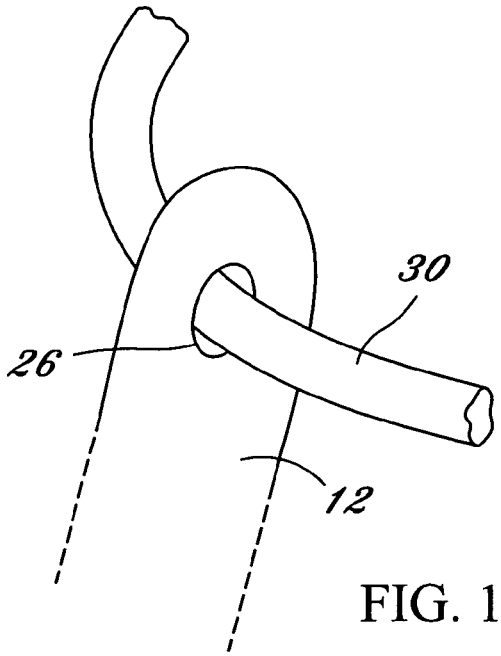
FIG. 11 is a partial perspective view of a preferred embodiment of the beverage cooling device.

Referring to FIG. 11, cooling unit 12 is shown hanging from collection device 30. Beverage cooling device 10 is preferably operated by first refrigerating device 10 in a freezer until coolant material 18 freezes. Preferably, device 10 is then removed from the freezer and one or more cooling units 12 are placed in a hot food or beverage. In preferred embodiments, device 10 does not have to be taken apart in any way in order for one or more cooling units 12 to be inserted into a food container. The one or more cooling units 12 are preferably removed from the hot food or beverage when the temperature of the food or beverage is reduced to an acceptable temperature.

Device 10 is preferably manufactured using injection molding technology in a sanitary facility. The material of construction of body 14 is a food safe, boiling safe and freezer safe plastic. Cavity 16 is preferably at least partially filled with sterile water, and sealed at the factory, with aperture 26 created in the manufacturing process. The amount of coolant material 18 introduced into cavity 16 and the size of cooling units 12 is preferably relatively precise, for optimal temperature reduction ability and user convenience.

Preferably, several cooling units 12 are attached to collection device 30 at the factory, because collection device 30 is a single ring of plastic having a closed joint, so as to prevent the accidental separation of cooling units from the collection device. Preferably, beverage cooling device is packaged in a user-friendly, see-through wrap, ready for purchase. The devices could be bulk wrapped for use in commercial venues.

Preferably, before its first use, the user unwraps the device and, following the directions on the package, washes the entire device in warm soapy water, rinses it, and places it in a freezer. After an appropriate freezing time, the device is ready for use.

When the user wished to consume a food or beverage product that is, in the user's estimation, too hot to comfortably or safely consume, the user removes the device from the freezer, selects an appropriate number of units to cool the food product, and inserts the units into a container containing the food product (the container, e.g., a mug, cup, bowl or plate, for the food or beverage being supplied by the user. The applicant has found that, in a preferred embodiment, a beverage cooling device containing about fifteen cubic centimeters (cc) of frozen water will cool a cup of liquid about fifteen degrees Fahrenheit within about thirty seconds of total immersion of the device in the liquid. This is a preferred amount of water used in one embodiment of a cooling unit but other embodiments contain other amounts of water. If the user needed more temperature reduction via the thermal energy storing capacity of each cooling unit, then the user could select another cooling unit and insert two cooling units into the food or beverage. Rather than inserting one at a time, the user could elect to insert two or three cooling units at a time, depending on the capacity of the food container to accept the additional volume of the cooling units without overflowing. When the user is satisfied that the food or beverage is cooled sufficiently, the user then rinses the used cooling units, and replaces the entire beverage cooling device back into the freezer, for future use.

Preferably, the tubular cooling units are either transparent enough to reveal that the coolant material has frozen/thawed, enabling the consumer to accurately choose the most appropriate/frozen cooling unit(s) for use. Preferably, the tubular cooling units are fabricated of a material that is soft enough to not break the food container as it is correctly inserted, moved through the beverage and withdrawn. In a preferred embodiment, the tubular cooling units are a color that is pleasant to the user's sense of aesthetics. Preferably, there is no leakage of coolant material, nor cracking, fragmenting or distress to the tubular cooling units during repeated freeze-thaw cycles. The packaging for the device and/or the device itself preferably contains a caution to dispose of any cooling unit that exhibits evidence of leakage or distress.

In summary, the applicant has researched background art inventions and has found that they rely on spouts, caps, straws or sealable covers that the user has to adjust, inner fittings that match pre-purchased beverage containers, or pre-threaded collars and lids, in order to provide a limited amount of cooling. The invention disclosed herein is not obvious because the need has apparently not been recognized by food-serving establishments. Commercially-available background art remedies impact the quality of the beverage to be cooled by dilution of the beverage.

Parents are often not aware that children have scalded their lips, tongues and mouths, and are unable to provide an option to their child that is easily accessible and non-toxic. Background art coolant devices are not meant to be used in a variety of home containers, and have not been proven safe for high-temperature exposure, because they are used for lowering room-temperature beverages to a more drinkable, desirable temperature. Background art devices are not designed to rectify a situation where a food or beverage has been heated to an unusable temperature.

Many variations of the invention will occur to those skilled in the art. Some variations include a plurality cooling units that are movable relative to the collection device. Other variations call for a single cooling unit. All such variations are intended to be within the scope and spirit of the invention.

Although some embodiments are shown to include certain features, the applicant(s) specifically contemplate that any feature disclosed herein may be used together or in combination with any other feature on any embodiment of the invention. It is also contemplated that any feature may be specifically excluded from any embodiment of an invention.

What is claimed is:

1. An apparatus for cooling a food or beverage in a single-portion food or beverage container comprising:

a collection device comprising a substantially circular ring having a permanently closed joint; and a plurality of cooling units, each of said cooling units comprising a top having a hole by which it is attached to said ring and a threaded male portion, each of said cooling units further comprising a transparent tubular container having an exterior, a part of said tubular container containing a cavity, said cavity having a substantially constant cross section and a threaded female portion that is attachable to said male portion and said cavity being at least partially fillable with a freezable coolant material that is visible from the exterior of said tubular container, said tubular container and said coolant material being food safe and said part being sufficiently small in size so as to be totally submergible in the food or beverage in the single-portion food or beverage container.

2. An apparatus for cooling a food or beverage in a single-portion food or beverage container comprising:

a collection device; and a plurality of cooling units, each of said cooling units having a hole by which it is attached to said collection device, each of said cooling units comprising a tubular container, a part of said tubular container containing a cavity, said cavity having a substantially constant cross section and said cavity being at least partially filled with a freezable coolant material, said tubular container and said coolant material being food safe and said part being immersible in the food or beverage in the single-portion food or beverage container.

3. The apparatus of claim 2 wherein the collection device comprises a band or ring and each of the cooling units has an aperture through which the band or ring passes, whereby said cooling units are collectable on said collection device, either side-by-side or spaced apart.

4. The apparatus of claim 2 wherein said tubular container is fabricated of a plastic material, said plastic material being elastic and maintaining at least some of its elasticity at the temperature at which said coolant freezes.

5. The apparatus of claim 2 wherein each cooling unit is removable from said collection device.

6. The apparatus of claim 2 wherein the coolant material is water.

7. A process for cooling a beverage comprising:

placing the apparatus of claim 2 in a freezer until the coolant material is frozen;

removing the apparatus of claim 2 from the freezer; and completely submerging said part of at least one of the cooling units in a food or beverage, thereby causing the temperature of the food or beverage to decrease.

8. A process for cooling a beverage comprising:

providing an apparatus comprising:

a cooling unit that includes a first portion of waterproof paper or another disposable material, a second portion of waterproof paper or other disposable material that is bonded to said first piece of waterproof paper or another disposable material so as to create a single cavity and a tabular handle, and a volume of coolant material that at least partially fills said single cavity;

placing said apparatus in a freezer until said coolant material is frozen;

removing said apparatus from the freezer; and immersing at least a portion of one of said cooling units in a beverage, thereby causing the temperature of the beverage to decrease.

9. An apparatus for cooling a hot food or beverage, said apparatus comprising:

a plurality of cooling units; and a collection device upon which said plurality of cooling units are collected;

wherein each of said cooling units includes a first portion of waterproof paper or another disposable material, a second portion of waterproof paper or other disposable material that is bonded to said first piece of waterproof paper or another disposable material so as to create a single cavity and a tabular handle, and a volume of coolant material that at least partially fills said single cavity.

10. The apparatus of claim 9 wherein said collection device comprises a band or ring and each of said cooling units has an aperture through which the band or ring passes, whereby said cooling units are collectable on said collection device, close together or spaced apart.

11. An apparatus for cooling a food or beverage in a single-portion food or beverage container comprising:

a collection device comprising a junction; and at least two cooling units immovably attached to said junction, each of said cooling units comprising a container, a part of said container containing a cavity that is at least partially filled with a freezable coolant material, said container and said coolant material being food safe and said part being immersible in the food or beverage in the single-unit food or beverage container.

12. An apparatus for cooling a food or beverage in a single-portion food or beverage container comprising:

a collection device comprising a junction; and at least two cooling units immovably attached to said junction, each of said cooling units comprising a container, a part of said container containing a cavity that is at least partially filled with a freezable coolant material, said container and said coolant material being food safe and said part being immersible in the food or beverage in the single-unit food or beverage container;

wherein said junction has four sides and one of four cooling units is immovably attached to each side of said junction.

13. A process for cooling a beverage comprising:

providing an apparatus that comprises a collection device comprising a junction, and at least two cooling units immovably attached to said junction, each of said cooling units comprising a container, a part of said container containing a cavity that is at least partially filled with a freezable coolant material, said container and said coolant material being food safe and said part being immersible in a beverage having a temperature;

placing said apparatus in a freezer until said coolant material is frozen;

removing said apparatus from said freezer; and immersing at least a portion of one of said cooling units in said beverage, thereby causing said temperature to decrease.

14. An apparatus for cooling liquid, semi-liquid or solid food for a user, the apparatus comprising:

a collection device comprising an openable ring; and a plurality of cooling units, each of said cooling units comprising an easily-cleanable tubular container permanently containing a coolant material and each of said cooling units being attachable and detachable to said ring by the user, and said coolant material being visible to the user;

wherein the collection device comprises a circular or non-circular band and each of the cooling units has an aperture through which the band is passable.

15. The apparatus of claim 14 wherein the coolant material is a freezable substance.

16. The apparatus of claim 15 wherein the coolant material is water.

17. A process for cooling a beverage comprising:

placing the apparatus of claim 14 in a freezer until the coolant material is frozen;

removing the apparatus of claim 14 from the freezer; and immersing at least a portion of one of the cooling units in a beverage contained in a single-portion container, thereby causing the temperature of the beverage to decrease.

* * * * *